United States Patent [19]

Minakawa et al.

[11] 4,344,280

[45] Aug. 17, 1982

[54] COMBUSTOR OF GAS TURBINE

[75] Inventors: Yoshimitsu Minakawa; Yoji Ishibashi; Isao Sato; Yoshihiro Uchiyama; Kazuyoshi Takahashi, all of Hitachi, Japan

[73] Assignee: Hitachi, Ltd., Tokyo, Japan

[21] Appl. No.: 114,970

[22] Filed: Jan. 24, 1980

[51] Int. Cl.[3] ..... F23R 3/34; F02C 7/22

[52] U.S. Cl. ..... 60/39.09; 60/747

[58] Field of Search ..... 60/746, 747, 39.06, 60/39.09 F, 742

[56] References Cited

U.S. PATENT DOCUMENTS

| | | | |
|---|---|---|---|
| 2,551,241 | 5/1951 | Buckland | 60/39.09 F |
| 2,635,425 | 4/1953 | Thorpe et al. | 60/742 |
| 2,814,180 | 11/1957 | Hession | 60/39.09 F |
| 3,034,297 | 5/1962 | Orchard et al. | 60/747 |
| 3,426,527 | 2/1969 | O'Connor | 60/742 |
| 3,690,093 | 9/1972 | Carlisle | 60/742 |
| 3,811,277 | 5/1974 | Markowski | 60/746 |
| 4,052,144 | 10/1977 | Marek | 165/105 |
| 4,062,183 | 12/1977 | Davies | 60/39.09 F |
| 4,193,260 | 3/1980 | Carlisle et al. | 60/746 |
| 4,194,358 | 3/1980 | Stenger | 60/747 |
| 4,246,758 | 1/1981 | Carvel et al. | 60/747 |

FOREIGN PATENT DOCUMENTS

| | | | |
|---|---|---|---|
| 55-46309 | 4/1980 | Japan | 60/747 |

*Primary Examiner*—Robert E. Garrett

*Attorney, Agent, or Firm*—Craig and Antonelli

[57] ABSTRACT

A combustor of a gas turbine including fuel distributing and supplying means including a plurality of sets of fuel nozzles arranged circularly on the head of the combustor and each fuel nozzle being provided with a combustion primary air swirler, and a plurality of fuel supply systems each connected to one fuel nozzle or a plurality of fuel nozzles. One set of fuel nozzles is located inside another set of fuel nozzles and projects further inwardly into the interior of the combustor. The number of the fuel supply systems handling a supply of fuel can be increased or reduced depending on the volume of fuel.

14 Claims, 9 Drawing Figures

COMBUSTOR OF GAS TURBINE

BACKGROUND OF THE INVENTION

This invention relates to can-type combustors of gas turbines and the like and, more particularly, to a combustor of the type described provided with fuel distributing and supplying means enabling stable combustion to be achieved over the entire operation range while reducing the amount of oxides of nitrogen produced in the combustor.

One type of fuel distributing and supplying means of the prior art used with a gas turbine is shown in FIG. 1, which includes a compressor 1 a combustor 2, a turbine 3, and a generator 50. Although only one combustor 2 is shown, there are provided a plurality of combustors 2 (6 to 12 in number) arranged annularly, with each combustor 2 having a fuel nozzle 4 connected to one end thereof. Each combustor 2 receives a supply of fuel from a master fuel conduit 7 by means of a fuel pump 9. The fuel from the master fuel conduit 7 is equally distributed to each combustor 2 by a fuel distributor 8 and delivered through a fuel conduit 14 mounting a check valve 16. The numeral 12 designates a fuel controller operative to effect control of the flow rate of the fuel by controlling a return adjusting valve 11 mounted on a bypass conduit 10 of the fuel pump 9 based on a flowrate signal generated by a fuel flowmeter 13.

In the conventional fuel distributing and supplying means described hereinabove, the greater part of oxides of nitrogen are produced in the form of nitrogen monoxide in the combustion of the fuel in each combustor 2. The nitrogen oxide is exhausted through the turbine 3 to the atmosphere and combines with oxygen into nitrogen dioxide. In this reaction process, ozone and other oxydants are produced as by products under the influences of ultraviolet rays and certain types of hydrocarbons. These substances give rise to photochemical smog when the meteorological conditions are favorable, thereby adversely affecting the human body. For this reason, oxides of nitrogen have recently attracted attention as principal air polluting substances, along with oxides of sulfur and carbon monoxide.

Production of nitrogen monoxide in the aforesaid combustion process will be discussed in some detail. It is known that production of nitrogen monoxide is maximized in the theoretical mixture combustion range and reduced in amount in two combustion ranges above and below the theoretical mixture combustion range or the rich mixture combustion range in which air for combustion is in deficiency and the lean mixture combustion range wherein air for combustion is in excess. Thus, in order to reduce the amount of nitrogen oxide produced in a combustor, two combustion systems or a rich mixture combustion system and a lean mixture combustion system are available. When the former system is adopted, a problem will be raised with regard to the production of black soot due to incomplete combustion of fuel because of the lack of air. Meanwhile the latter system has been considered to be perferable because the presence of excess air does not produce the problem of black soot.

In the multiple can-type combustor for a gas turbine shown in FIG. 1, each combustor 2 is constructed to have a fuel nozzle 4. The adoption of the single fuel nozzle construction results in a wide variation (from 200 to about 50) in the air-fuel ratio from no load to high load condition, so that operation of the combustor 2 should be performed in this wide air-fuel ratio range. Because of this, if the combustor 2 is adjusted such that the aforementioned lean mixture combustion can be effected at high load, the air-fuel ratio will greatly rise at low load, with a result that combustion will become unstable at low load. Also, when each combustor is provided with one fuel nozzle, the rich mixture combustion or theoretical mixture combustion will take place in the vicinity of the fuel nozzle because air flow does not reach the fuel nozzle, even if air for combustion is introduced into the combustor in an amount which is on the excess side on an average. Thus, no great effects could be achieved in reducing the amount of oxides of nitrogen produced, although production of black soot can be avoided.

SUMMARY OF THE INVENTION

This invention has as its object the provision of a combustor provided with fuel distributing and supplying means capable of achieving stable combustion while reducing the amount of oxides of nitrogen produced, in view of the aforesaid disadvantages of the prior art.

In order to accomplish the aforesaid object, the fuel distributing and supplying means includes a plurality of fuel nozzles provided for the combustor, and a plurality of fuel supply systems for the fuel nozzles arranged such that each fuel supply system supplies fuel to a single fuel nozzles or a plurality of fuel nozzles, the number of fuel supply systems supplying fuel to the combustor being increased or reduced depending on the volume of fuel. The fuel nozzles forming one set are circularly arranged, and the fuel nozzles forming another set are also circularly arranged, the fuel nozzles of the second set being located inside the fuel nozzles of the first set and extending at their forward ends further inwardly into the interior of the combustor than the fuel nozzles of the first set.

DESCRIPTION OF THE PREFERRED EMBODIMENTS

Figure 1:
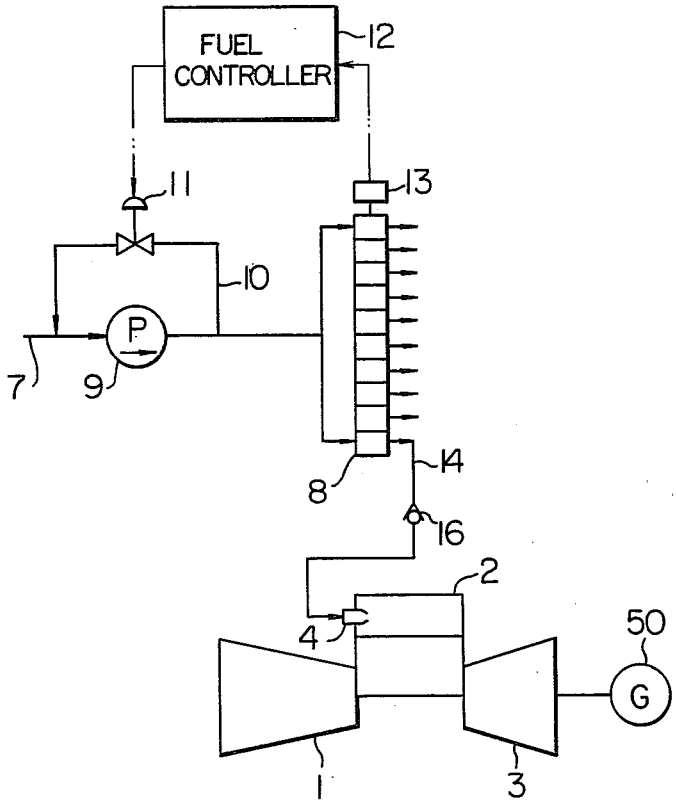
FIG. 1 PRIOR ART
FIG. 1 is a systematic view of the fuel distributing system of a multiple can-type combustor of the prior art.
Figure 2:
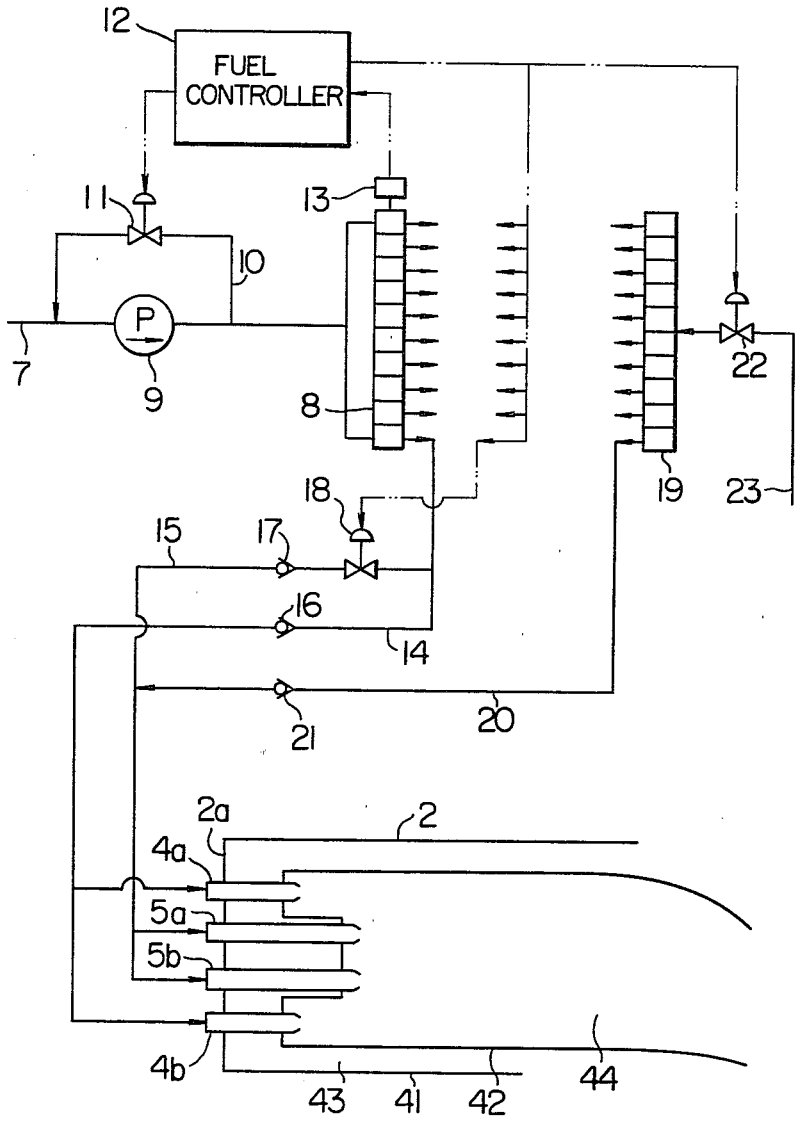
FIG. 2 is a systematic view of the fuel distributing and supplying means of a multiple can-type combustor comprising one embodiment of the invention.
Figure 3:
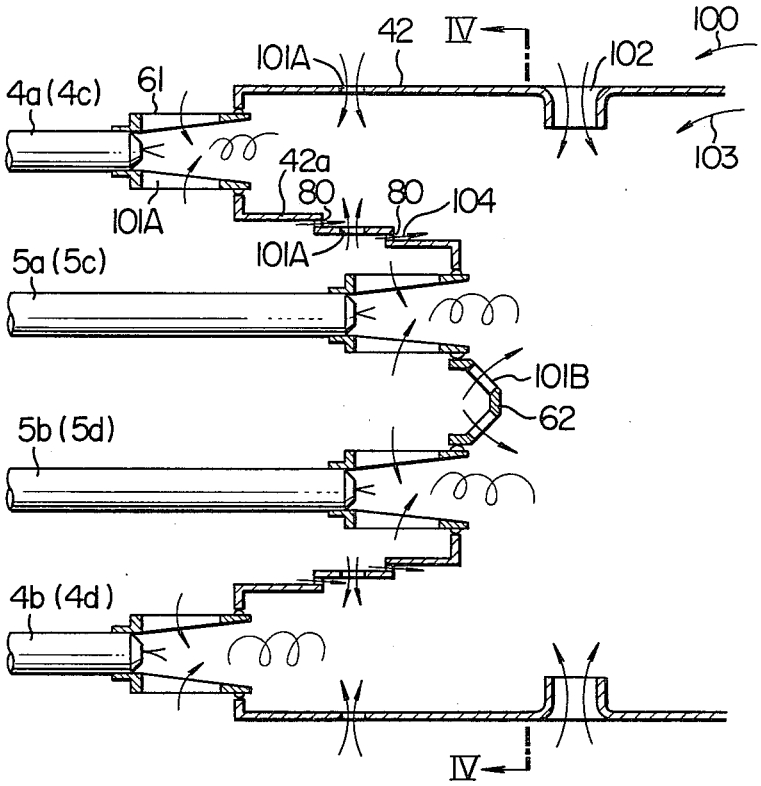
FIG. 3 is an enlarged sectional view of the interior of the combustor in FIG. 2.
Figure 4:
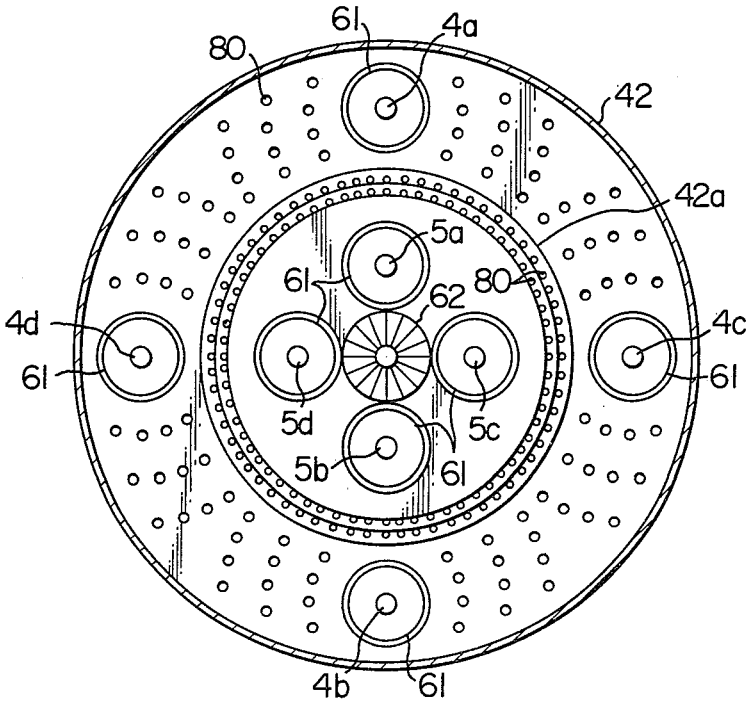
FIG. 4 is a sectional view as seen along the arrows IV—IV in FIG. 3.

Preferred embodiments of the invention will now be described by referring to the accompanying drawings. FIGS. 2, 3 and 4 show a first embodiment wherein the combustor 2 includes a combustor outer cylinder 41, a combustor inner cylinder 42 and an annular space 43 defined by the outer and inner combustor cylinders 41 and 42 and serving as an air flow passage which receives a supply of compressed air as shown in FIG. 1. Although only one combustor 2 is shown, it is to be understood that in actuality 6 to 12 combustors of similar construction are provided, and only one combustor is shown and described in the interest of brevity. The combustor 2 has a head 2*a* provided with four primary fuel nozzles 4*a*, 4*b*, 4*c* and 4*d* and four secondary fuel nozzles 5*a*, 5*b*, 5*c* and 5*d*. The primary fuel nozzles 4*a*, 4*b*, 4*c* and 4*d* are arranged circularly, and the secondary fuel nozzles 5*a*, 5*b*, 5*c* and 5*d* are also arranged circularly and located inside the primary fuel nozzles 4*a*, 4*b*, 4*c* and 4*d* and the primary and secondary nozzles are securely applied to a combustor cover 2*a*. The injection openings of the secondary fuel nozzles 5*a*, 5*b*, 5*c* and 5*d* are extended further inwardly into the combustion chamber 44 than the injection openings of the primary fuel nozzles 4*a*, 4*b*, 4*c* and 4*d* and the primary nozzles and secondary nozzles are provided to direct toward a combustion chamber 44 through the opening portion of a combustor inner cylinder cap 42*a* formed in convex-shape. The primary fuel nozzles 4*a*, 4*b*, 4*c*, 4*d* and secondary fuel nozzles 5*a*, 5*b*, 5*c*, 5*d* are each provided with an air swirling means 61 for supplying fuel combustion primary 101A, 101B in swirling motion into the combustion chamber 44. A center air swirling means 62 is mounted to connect to the combustor inner cylinder cap 42*a* in the center of the combustor 2 in a manner to project further inwardly than the secondary fuel nozzles 5*a*, 5*b*, 5*c* and 5*d*.

In the meantime, the combustor inner cylinder cap 42*a* is applied a multi-stepped cylinder as the projecting cylinder portion inwardly to keep cooling and a plurality of cooling air parts 80 are provided to the peripheral wall surface of the combustor inner cylinder cap 42*a* so as to direct toward the stepped portion, the primary fuel nozzles 4*a*, 4*b*, 4*c* and 4*d* and the secondary fuel nozzles 5*a*, 5*b*, 5*c* and 5*d*. In the combustor constructed as aforesaid, the fuel combustion primary air 101A is introduced into the combustion chamber 44 through the air swirling means 61, the combustor inner cylinder 42 and the combustor inner cylinder cap 42*a* and forms a mixture with primary fuel from primary fuel conduit 14 and air. Likewise, fuel combustion primary air 101B is introduced into the combustion chamber 44 through the air swirling means 61 and the central air swirling means 62 and forms a mixture with secondary fuel from secondary fuel conduit 15.

By the aforesaid structural arrangement, the fuel distributing and supplying means cooperating with the fuel distributing system of the prior art and introducing excess air into the combustor 2 is capable of achieving combustion of lean mixtures over the entire operation range while reducing the amount of oxides of nitrogen produced. Compressor outlet air 100 flows through the annular air flowing space 43 into the combustor inner cylinder 42 as primary air 101A, 101B, secondary air 102, tertiary air 103 further, cooling air 104 through cooling air parts 80 of the combustor inner cylinder cap 42*a* and cooling air through cooling air ports (not shown) of the combustor inner cylinder and the like. It is the primary air 101A, 101B and secondary air 102 that is used as combustion air, while the tertiary air 103 serves as cooling air for reducing the temperature of combustion gas to a level allowed for introduction into the turbine 3. The amount of air for combustion introduced through the air swirling means 61 is preferably such that with a view to obtaining stable ignition performance of an air-fuel mixture and achieving stable combustion thereof in the combustion chamber 44, the amount of air is preferably below twice the theoretical air volume when the fuel volume is minimum, and in order to effectively reduce the amount of oxides of nitrogen produced, it is necessary that the amount of air be over 0.5 time the theoretical air volume when the flow rate of fuel is maximized.

The fuel distributing and supplying means described hereinabove is connected to the fuel distributing system of the prior art shown in FIG. 1. The fuel distributor 8 (FIG. 2) is connected through a fuel conduit to each combustor 2, and the fuel conduit branches midway between the distributor 8 and combustor 2 into a primary fuel conduit 14 connected to the primary fuel nozzles 4*a*, 4*b*, 4*c* and 4*d* and a secondary fuel conduit 15 connected to the secondary fuel nozzles 5*a*, 5*b*, 5*c* and 5*d*. Check valves 16 and 17 are mounted in the primary fuel conduit, 14 and secondary fuel conduit 15, respectively. The secondary fuel conduit 15 has mounted therein a secondary fuel on-off valve 18 actuated by a signal from the controller 12 and has connected thereto a purging air conduit 20 mounting a check valve 21 and extending from an air distributor 19. The air distributor 19 has connected thereto a master air conduit 23 mounting an air on-off valve 22 actuated by a signal from the controller 12, so that pressurized air will be supplied from a pressurized air source, now shown, through the master air conduit 23.

In the structural arrangement described hereinabove, when the flow rate of fuel is below one half the maximum flow rate, the secondary flow on-off valve 18 and air on-off valve 22 are set at closed and open positions respectively. This permits fuel to be supplied to the primary fuel nozzles 4*a*, 4*b*, 4*c* and 4*d* and air to be supplied to the secondary fuel nozzles 5*a*, 5*b*, 5*c* and 5*d*. As a result, combustion takes place with the fuel supplied through the primary fuel nozzles 4*a*, 4*b*, 4*c* and 4*d* alone, and the air supplied to the combustor 2 through the secondary fuel nozzles 5*a*, 5*b*, 5*c* and 5*d* effects cooling of the secondary fuel nozzles to prevent temperatures thereof from rising to a high level. The air supplied to the secondary fuel nozzles 5*a*, 5*b*, 5*c* and 5*d* performs the functions of preventing obturation of the flow passages and corrosion thereof.

Upon the flow rate of fuel rising to a level higher than one half the maximum fuel flow rate, a signal from the controller 12 opens the secondary fuel on-off valve 18 and closes the air on-off valve 22, thereby starting combustion with the fuel supplied through the secondary fuel nozzles 5*a*, 5*b*, 5*c* and 5*d*. At this time, the pressure under which the fuel is injected through the primary fuel nozzles 4*a*, 4*b*, 4*c* and 4*d* becomes equal to the pressure under which the fuel is injected through the secondary fuel nozzles 5*a*, 5*b*, 5*c* and 5*d*, so that the flow rate of the fuel flowing through the primary fuel conduit 14 and the flow rate of the fuel flowing through the secondary fuel conduit 15 become equal to each other so long as the primary fuel nozzles 4*a*, 4*b*, 4*c* and 4*d* are equal in number and size of the opening, compared to the secondary fuel nozzles 5*a*, 5*b*, 5*c* and 5*d*.

As described hereinabove, each combustor 2 is provided with a plurality of sets of fuel nozzles arranged in spaced apart positions instead of only one fuel nozzles as in the prior art, and excess air is supplied to the vicinity of each fuel nozzle. By this arrangement, a combustion load per one fuel nozzle is reduced and combustion actually taking place will be combustion of lean mixtures although the air-fuel ratio is equal to that of the prior art, thereby promoting the uniform mixture mixed with fuel and air and enabling the amount of oxides of nitrogen produced to be reduced. By actuating only the primary fuel nozzles 4*a*, 4*b*, 4*c* and 4*d* when the fuel flow rate is below one half the maximum fuel flow rate and by actuating the secondary fuel nozzles 5*a*, 5*b*, 5*c* and 5*d* too when the fuel flow rate exceeds one half the maximum fuel flow rate as in this embodiment, the air-fuel ratio per one fuel nozzle is reduced in operation range from 200–50 to 200–100 and the stability of combustion is increased, thereby enabling production of oxides of nitrogen by further promoting combustion of lean mixtures on an average. Switching of the combustor 2 between different fuel supply systems is carried out simultaneously in all the combustors 2, thereby eliminating interference of the combustors 2 with one another and increasing the stability of combustion.

Figure 5:
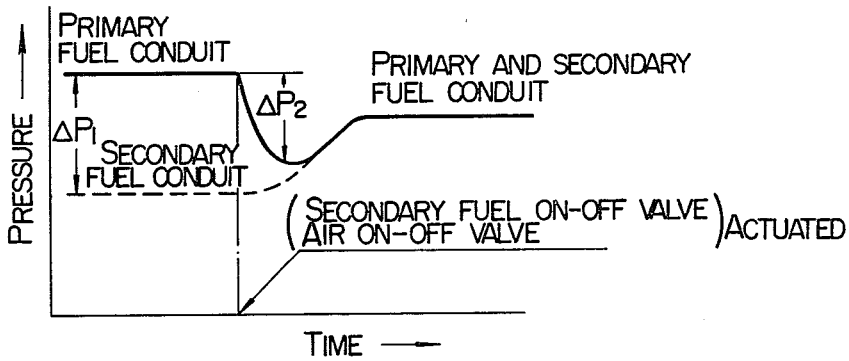
FIG. 5 is a view in explanation of variations occurring in the internal pressure of the fuel conduits of the fuel distributing and supplying means shown in FIG. 2.

The embodiment shown in FIG. 2 is not without problems. FIG. 5 shows variations in the internal pressure of the primary fuel conduit 14 and secondary fuel conduit 15 taking place when the secondary fuel on-off valve 18 and air on-off valve 22 are simultaneously actuated. These variations have been produced when the internal pressure of the secondary fuel conduit (air) is lower than that of the primary fuel conduit (fuel) during operation of the combustor 2. When the secondary fuel on-off valve 18 and air on-off valve 22 are actuated as shown in FIG. 5, supply of air to the secondary fuel conduit 15 is interrupted and supply of fuel thereto is initiated, so that the internal pressure of the secondary fuel conduit 15 rises toward a level at which equilibrium is obtained with the internal pressure of the primary fuel conduit 14. Meanwhile the internal pressure of the primary fuel conduit 14 rapidly falls with the initiation of fuel supply to the secondary fuel conduit 15. When the pressure differential between the primary fuel conduit 14 and secondary fuel conduit 15 prior to actuation of the secondary fuel on-off valve 18 and air on-off valve 22 and the maximum pressure variation between these two conduits after actuation of these valves are denoted by $\Delta P_1$ and $\Delta P_2$ respectively, it will be seen that $\Delta P_2$ increases with an increase of $\Delta P_1$. This suddenly reduces the pressure under which fuel is injected into the combustion chamber 44 through the primary fuel nozzles 4*a*, 4*b*, 4*c* and 4*d* and greatly influences combustion, thereby giving rise to the trouble of the flames being blown out. If the internal pressure of the secondary fuel conduit 15 (air) is set at a higher level than that of the primary fuel conduit 14 (fuel) to avoid this flame blow-out, the influences exerted on combustion by actuation of the secondary fuel on-off valve 18 and air on-off valve 22 can be reduced, but a problem will be raised with regard to the pressurized air supply source in that the power for driving the pressurized air source should be increased and consequently expenses for providing necessary power will increase when the fuel flow rate is below one half the maximum fuel flow rate because a large volume of air flows under high pressure.

Figure 6:
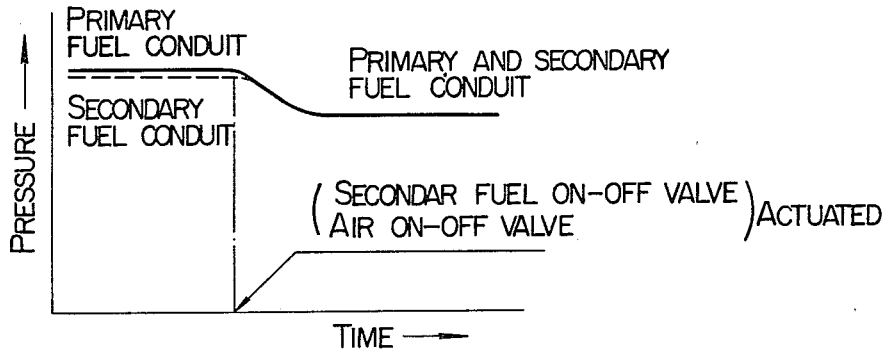
FIG. 6 is a view in explanation of ideal variations occurring in the internal pressure of the fuel conduits of the fuel and air distributing and supplying means shown in FIG. 2.
Figure 8:
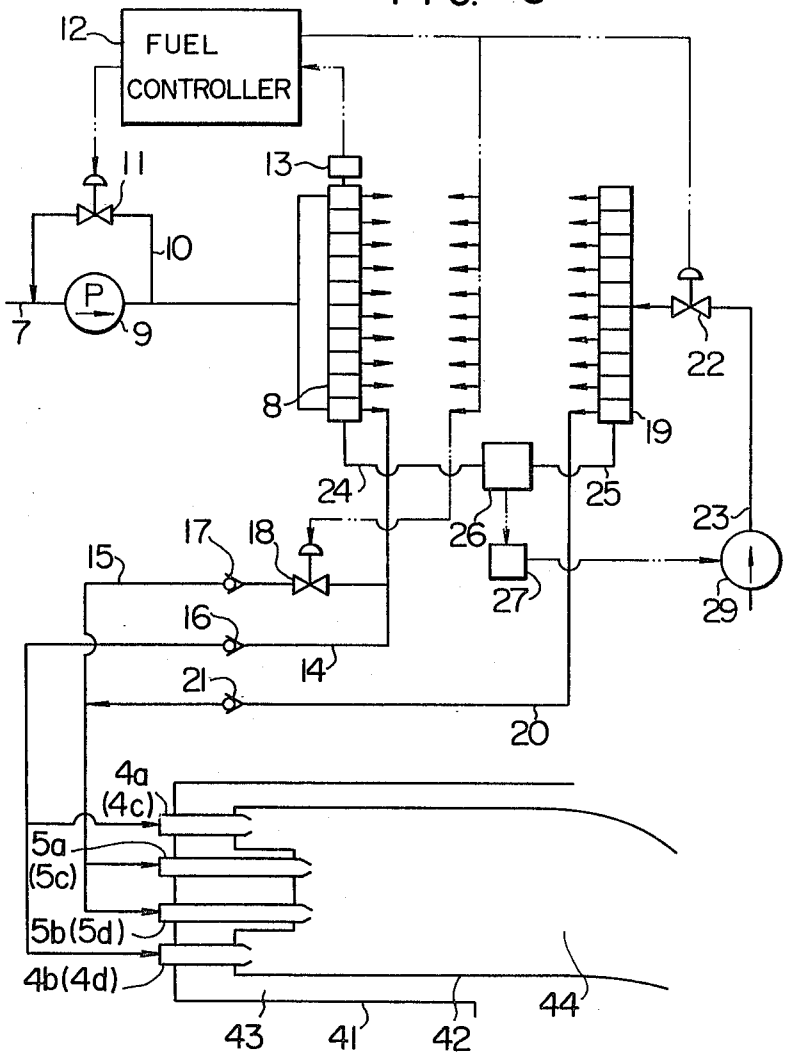
FIG. 7–9 are systematic views of other embodiments.
Figure 7:
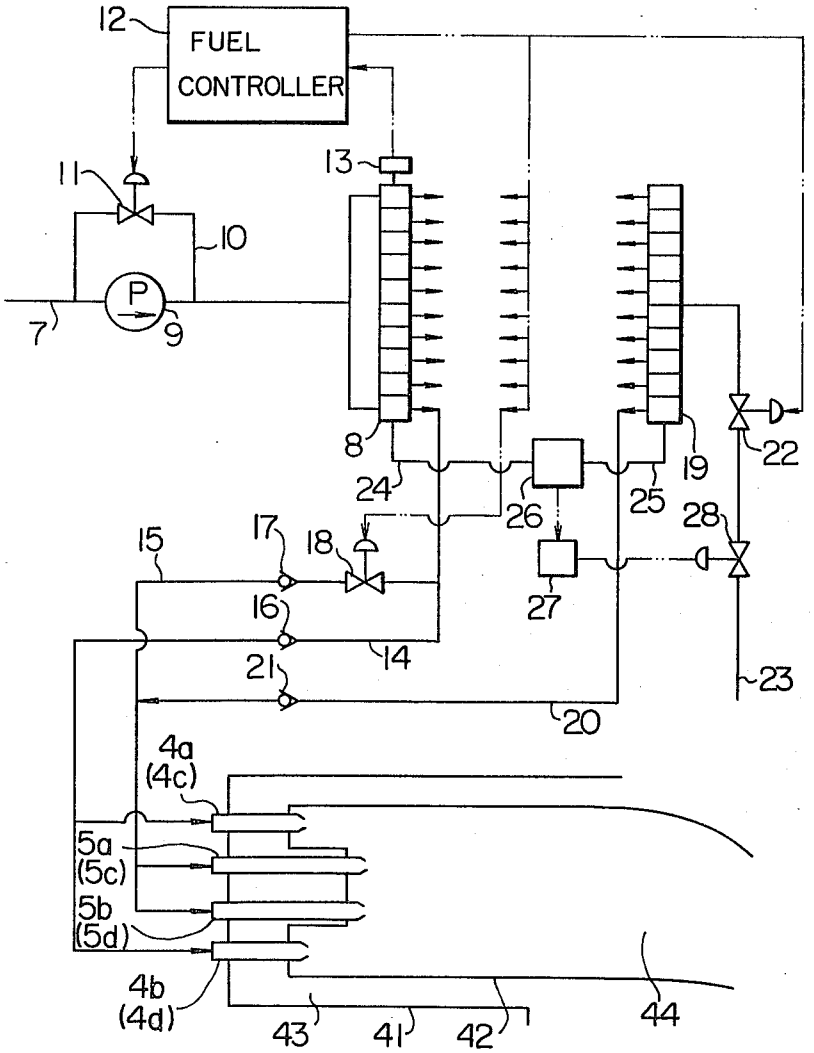

FIGS. 7 and 8 show embodiments which obviate the aforesaid problem by reducing the pressure differential between the primary fuel conduit 14 (fuel) and secondary fuel conduit 15 (air) in a manner to enable pressure follow-up of the two conduits to be effected and variations in pressure of the two conduits after actuation of the secondary fuel on-off valve 18 and air on-off valve 22 to take place as shown in FIG. 6.

The embodiment shown in FIG. 7 will first be described, wherein parts similar to those shown in FIG. 2 are designated by like reference characters and their description is omitted. The embodiment shown in FIG. 7 is distinct from that shown in FIG. 2 in that pressure drawing-off tubes 24 and 25 for drawing off the fuel pressure and air pressure are connected to the fuel distributor 8 an air distributor 19 respectively at one end thereof and to a differential pressure signal generator 26 at the other end thereof. A signal generated in the differential pressure signal generator 26 is transmitted to a controller 27 which in turn generates a signal to actuate a pressure control valve 28 mounted in the master air conduit 23.

In this embodiment (FIG. 7), a rise in the pressure in the fuel distributor 8, for example, raises the pressure differential between the fuel distributor 8 and air distributor 19 with respect to a differential pressure reference value at which the controller 27 is set, so that the pressure control valve 28 is opened to increase the pressure in the air distributor 19. That is, a pressure follow-up occurs between the fuel distributor 8 and air distributor 19 so that the pressure in the air distributor 19 undergoes a variation following up the pressure variation in the fuel distributor 8. In this way, the pressure control valve 28 functions to keep constant the pressure differential between the fuel distributor 8 and air distributor 19 at all times. The pressure differential can be selected at a desired level by varying the differential pressure reference value at which the controller 27 is set. Since the primary fuel conduit 14 (fuel) and secondary fuel conduit (air) are connected to the distributors 8 and 19 respectively, it is possible to set the pressure differential between the fuel conduits 14 and 15 at a low level as shown in FIG. 6 as a result of the aforesaid pressure control. Thus in this embodiment, actuation of the secondary fuel on-off valve 18 and air on-off valve 22 produces no sudden and large variation in pressure in the primary fuel conduit 14 (fuel) as shown in FIG. 5, thereby minimizing influences on combustion. The arrangement that the pressure in the secondary fuel conduit 15 (air) is made to follow-up the pressure in the primary fuel conduit 14 (fuel) eliminates the need to cause air to flow in excess which is required when the problem of flame blow-out is solved by setting the pressure in the secondary fuel conduit 15 at a high constant level. Thus, the embodiment offers the advantages that it is possible to economize on power expenses for the pressurized air source and that pressure control is effected to conform to fuel automatic operation of the combustor.

The embodiment shown in FIG. 8 will now be described. This embodiment is distinct from the embodiment shown in FIG. 7 in that instead of controlling the internal pressure of the secondary fuel conduit 15 by the pressure control valve 28, a signal generated by the controller 27 is transmitted to the pressurized air source 29 which, in this embodiment, is of a rotational speed variable type, for example, and capable of varying the volume of delivered air by controlling its number of revolutions, to thereby ensure that the internal pressure of the secondary fuel conduit 15 (air) is kept at a desired level. This embodiment is capable of achieving the same effect as the embodiment shown in FIG. 7 and also of operating the pressurized air source 29 in such a manner that air is delivered in an essential minimum volume, thereby permitting operating cost to be reduced.

Figure 9:
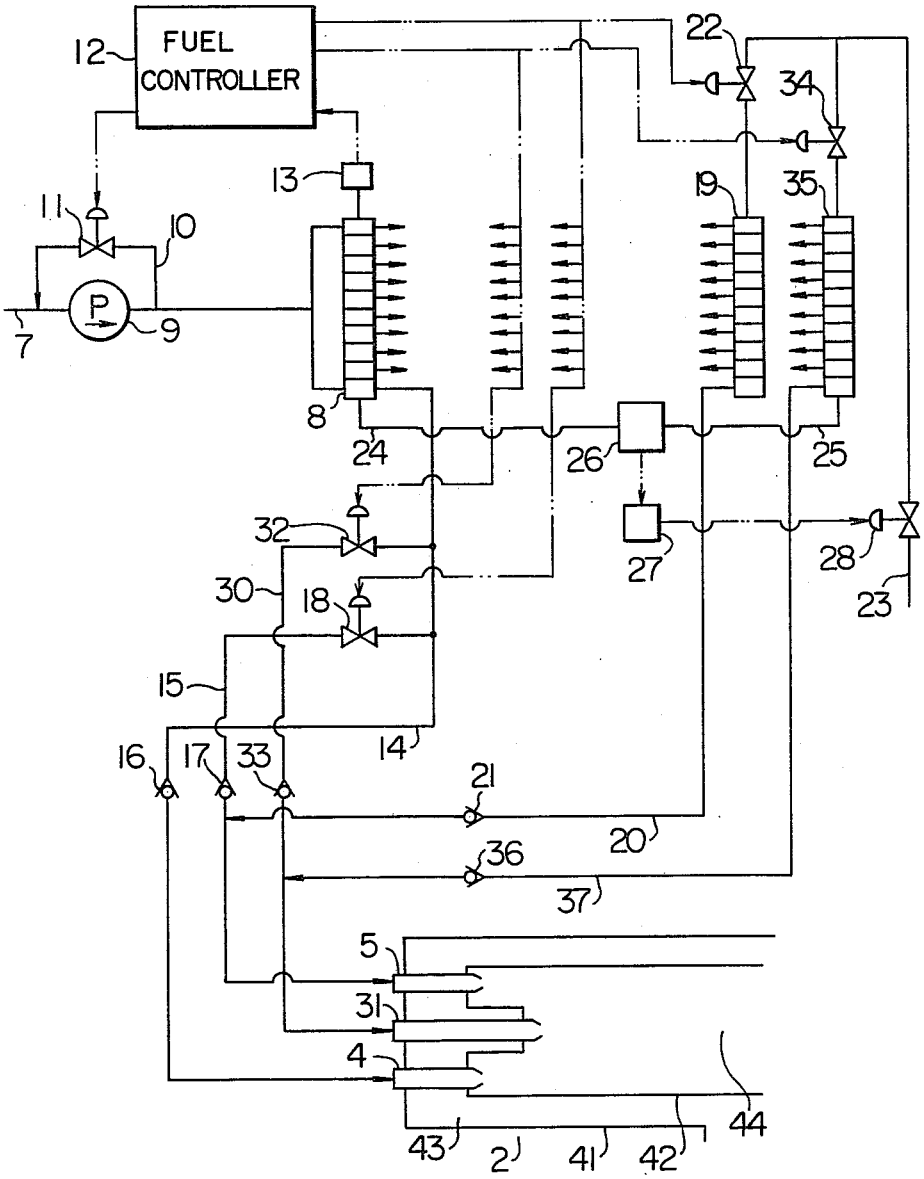

In the embodiments shown and described hereinabove, a plurality of nozzles are divided into primary and secondary fuel nozzles of separate fuel supply systems. However, it is to be understood that the invention is not limited to this specific number of fuel supply systems and that over three fuel supply systems may be provided so as to increase or reduce the number depending on the fuel flow rate. FIG. 9 shows an embodiment provided with three fuel supply systems. In this embodiment, the fuel distributing and supplying means includes a tertiary fuel nozzle 31 in addition to the primary and secondary fuel nozzles 4 and 5, the tertiary fuel nozzle 32 being connected to a tertiary fuel conduit 30 having a tertiary fuel on-off valve 32 and a check valve 33 mounted therein, and a purging air conduit 37 branching from the meter air conduit 23 and connected to the tertiary fuel conduit 30 by way of an air distributor 35 while mounting an air on-off valve 34 and a check valve 36 therein. The tertiary fuel on-off valve 32 and air on-off valve 34 are each actuated by a signal from the controller 12, and the air pressure drawing-off tube 25 is connected to the air distributor 35, not to the air distributor 19 as in the embodiment shown in FIG. 7. The controller 12 is constructed such that when the fuel flow rate is over one third the maximum fuel flow rate is transmits an opening signal and a closing signal to the secondary fuel on-off valve 18 and the air on-off valve 22 respectively, and that when the fuel flow rate is over two thirds the maximum fuel flow rate it transmits an opening signal and a closing signal to the tertiary fuel on-off valve 32 and air on-off valve 34 respectively.

In operation, the secondary fuel on-off valve 18 opens and the air on-off valve 22 close when the fuel flow rate reaches one third the maximum fuel flow rate, and the tertiary fuel on-off valve 32 opens and the air on-off valve 34 closes when the fuel flow rate reaches two thirds the maximum fuel flow rate. During this period, the pressure control valve 28 is in operation so that no sudden and large variations occur in the fuel conduits 14, 15 and 30 and the valves are smoothly opened and closed.

It will be appreciated that if the number of conduits is increased as described by referring to the embodiment shown in FIG. 8, it is possible to provide fuel and air distributing and supplying means having more than three fuel distributing systems.

The invention has been described in detail by referring to the prefered embodiments thereof. The outstanding characteristics of the invention are that a plurality of fuel nozzles are provided to each combustor, and a plurality of fuel supply systems are connected to the plurality of fuel nozzles in such a manner that each fuel supply system supplies fuel to one fuel nozzle or to one set of fuel nozzles, the number of fuel supply nozzles actuated to supply fuel being increased or reduced depending on the volume of fuel. Thus, the invention offers the advantages that combustion load per one fuel nozzle can be reduced, and the operation range for the air-fuel ratio can be narrowed, so that the amount of oxides of nitrogen produced can be reduced together with the stability of the lean mixture combustion can be realized.

What is claimed is:

1. A combuster of a gas turbine comprising:

fuel distributing and supplying means including:

a plurality of fuel nozzles provided to said combustor; and a plurality of fuel supply systems connected to said plurality of fuel nozzles, each of said fuel supply systems supply fuel to one fuel nozzle or a set of fuel nozzles, the number of the fuel supply systems for handing fuel being increased or reduced depending on the volume of fuel, said combustor being one of a plurality of combustors of said gas turbine comprising a fuel distributor for distributing fuel in equal volume to all the combustors, and wherein said plurality of fuel supply systems of said fuel distributing and supplying means of each combustor are connected to said distributor so that the fuel supply systems of all the combustors can be actuated simultaneously, and wherein said fuel distributing and supplying means further includes a purging air supply system for supplying air to the fuel nozzles and the fuel supply system which is handling no fuel, and further comprising purging air pressure control means provided to said purging air supply system which is handling purging air to follow up the pressure in the fuel supply system which is handling fuel.

2. A combustor of a gas turbine comprising:

fuel distributing and supplying means including:

a plurality of fuel nozzles provided to said combustor; and a plurality of fuel supply systems connected to said plurality of fuel nozzles, each of said fuel supply systems supplying fuel to one fuel nozzle or a set of fuel nozzles, the number of the fuel supply systems for handling fuel being increased or reduced depending on the volume of fuel, wherein said fuel distributing and supplying means further includes a purging air supply system for supplying air to the fuel nozzles and the fuel supply system which is handling no fuel, and further comprising purging air pressure control means provided to said puring air supply system for causing the pressure in the fuel supply system which is handling purging air to follow up the pressure in the fuel supply system which is handling fuel.

3. A combustor as claimed in claim 2, wherein said purging air pressure control means includes a means for detecting the pressure differential between the fuel supply system which is handling fuel and the fuel supply system which is handling purging air, and a pressure control valve operative to control the purging air supply pressure upon receipt of an output signal of said pressure differential detecting means.

4. A combustor as claimed in claim 2, wherein said purging air pressure control means includes a means for detecting the pressure differential between the fuel supply system which is handling fuel and the fuel supply system which is handling purging air, and a pressurized air source controlled by an output signal of said pressure differential detecting means.

5. Fuel distributing and supplying means for a combustor of a gas turbine comprising:

a plurality of fuel nozzles being provided to said combustor, said plurality of fuel nozzles being divided into primary fuel nozzles which are supplied fuel regardless of fuel flow rate, and secondary fuel nozzles which are supplied fuel after fuel flow rate reaches a predetermined volume;

a plurality of fuel supply systems being disposed to said primary and secondary fuel nozzles respectively so as to supply fuel;

a purging air supply system being disposed to said secondary fuel nozzles so as to supply purging air;

valves being provided to said fuel supply system and said purging air supply system which are connected to said secondary fuel nozzles; and control means being disposed to open and shut said valves corresponding to fuel flow rate which is supplied to said combustor, said control means controlling said valves disposed to said purging said supply system so as to make within a predetermined range a pressure differential between purging air pressure supplied to said secondary fuel nozzle and fuel pressure supplied to said primary fuel nozzle, whereby, supply of fuel or purging air to said secondary fuel nozzles can be shifted.

6. Fuel distributing and supplying means as claimed in claim 5, wherein a plurality of combustors are disposed, and a fuel distributor for distributing fuel in equal volume to said fuel supply system of each one of said plurality of combustors is disposed to a common master fuel conduit which supplies fuel to each one of said plurality of combustors.

7. Fuel distributing and supplying means as claimed in claims 5 or 6, wherein a purging air distributor for distributing purging air in equal volume to a purging air supply system of each one of said plurality of combustors is disposed to a common master purging air conduit which supplies purging air to said secondary fuel nozzles of each one of said plurality of combustors.

8. A combustor of a gas turbine comprising:

a head;

a plurality of fuel nozzles circularly arranged on said head being provided to said combustor, said plurality of fuel nozzles being divided into primary fuel nozzles which are supplied fuel regardless of fuel flow rate, and second fuel nozzles which are supplied fuel after fuel flow rate reaches a predetermined volume, said secondary fuel nozzles provided with a combustion primary air swirler, said secondary fuel nozzles being located inside said primary fuel nozzles and having forward ends projecting further inwardly into the interior of said combustor than said primary fuel nozzles, and said forward ends of the primary and secondary fuel nozzles are directed toward a combustion chamber through the opening portion of a convex-shaped combustor inner cylinder cap having cooling air ports;

a plurality of fuel supply systems being disposed to said primary and secondary fuel nozzles respectively so as to supply fuel;

a purging air supply system being disposed to said secondary fuel nozzles so as to supply purging air;

valves being provided to said fuel supply system and said purging air supply system which are connected to said secondary fuel nozzles; and control means being disposed to open and shut said valves corresponding to fuel flow rate which is supplied to said combustor, said control means controlling said valves disposed to said purging air supply system so as to make within a predetermined range a pressure differential between purging air pressure supplied to said secondary fuel nozzle and fuel pressure supplied to said primary fuel nozzle, whereby supply of fuel or purging air to said secondary fuel nozzles can be shifted.

9. A combustor for a gas turbine comprising:

at least one first fuel nozzle for said combustor, at least one second fuel nozzle for said combustor, fuel distributor means providing fuel output under pressure at a flow rate to said at least one first and second fuel nozzles, first air distributor means for receiving air input to provide an output under pressure to said at least one fuel nozzle including said first fuel nozzle, fuel controller means for generating signals, means controlling the output of said fuel distributor means to said second fuel nozzle in response to a first equal of said signals and air control means controlled so as to make within a predetermined range a pressure differential between air pressure supplied from said first air distributor means and fuel pressure supplied from said fuel distributor means being disposed.

10. A combustor for a gas turbine as set forth in claim 9, wherein said fuel control means generates a second signal, and characterized by means recording to said second signal to control the air input to said air distributor means.

11. A combustor for a gas turbine as set forth in claim 10, wherein said fuel control means comprises means to close fuel output from said fuel distributor means to at least one of said second fuel nozzles while maintaining said output of said first air distributor means when a predetermined level of flow rate of fuel of said fuel distributor means is below a maximum level and, when said predetermined flow rate of fuel is exceeded to open said fuel output from said fuel distributor means to said at least one of said second fuel nozzles while closing said air inlet to said first air distributor means.

12. A combustor for a gas turbine as set forth in one of claims 10 or 11 further comprising means for sensing the pressure differential between said fuel distributor means and said air distributor means to control said air input to said first air distributor means.

13. A combustor for a gas turbine as set forth in claim 12 comprising at least a third nozzle means for receiving at least one of fuel and air, means to allow transmission of fuel output from said fuel distributor to at least one of said second fuel nozzles while closing said air input to said air distributor means when said fuel flow rate of said fuel distributor means is above a second predetermined level less than maximum, and when said fuel flow rate is above a third predetermined level which is greater than said second predetermined level and less than maximum, to allow transmission of fuel to said third nozzle means while closing air input to said third nozzle means.

14. Fuel distributing and supplying means for a combustor of a gas turbine comprising:

a plurality of fuel nozzles being provided to said combustor, said plurality of fuel nozzles being divided into primary fuel nozzles which are supplied fuel regardless of fuel flow rate, and secondary fuel nozzles which are supplied fuel after fuel flow rate reaches a predetermined volume;

a plurality of fuel supply systems being disposed to said primary and secondary fuel nozzles respective so as to supply fuel;

a purging air supply system being disposed to said secondary fuel nozzles so as to supply purging air;

valves being provided to said fuel supply system and said purging air supply system which are connected to said secondary fuel nozzles; and means for reducing production of oxides of nitrogen and for preventing sudden pressure drop in fuel supplied to the primary nozzles to prevent blowout comprising control means being disposed to open and shut said valves corresponding to fuel flow rate which is supplied to said combustor, said control means controlling said valves disposed to said purging air supply system so as to make within a predetermined range a pressure differential between purging air pressure supplied to said secondary fuel nozzle and fuel pressure supplied to said primary fuel nozzle, whereby supply of fuel or purging air to said secondary fuel nozzles can be shifted.

* * * * *